United States Patent [19]

Dumas

[11] 3,944,708

[45] Mar. 16, 1976

[54] SYNTHETIC FIBERS AND PROCESS FOR MAKING SAME

[75] Inventor: Victor Dumas, Sainte-Foy-les-Lyon, France

[73] Assignee: Rhone-Poulenc Textile, Paris, France

[22] Filed: Jan. 21, 1974

[21] Appl. No.: 434,993

[30] Foreign Application Priority Data

Jan. 19, 1973 France ..... 73.02197

[52] U.S. Cl. ..... 428/400; 264/178 F; 428/398; 428/401

[51] Int. Cl.[2] ..... D01D 5/08; D02G 3/00

[58] Field of Search ..... 161/175, 177, 178, 180; 264/178 F; 428/373, 397, 398, 400, 401

[56] References Cited

UNITED STATES PATENTS

| | | | |
|---|---|---|---|
| 2,200,946 | 5/1940 | Bloch | 161/180 X |
| 2,324,397 | 7/1943 | Hull | 264/178 F |
| 2,904,840 | 9/1959 | Hochreuter | 161/178 X |
| 3,155,754 | 11/1964 | Adams | 161/175 X |
| 3,550,369 | 12/1970 | Pitzl | 161/180 X |
| 3,671,381 | 6/1972 | Hansen | 161/180 |
| 3,728,072 | 4/1973 | Orito et al. | 161/180 X |

*Primary Examiner*—Lorraine T. Kendell
*Attorney, Agent, or Firm*—Cushman, Darby & Cushman

[57] ABSTRACT

Synthetic filaments having a dull appearance and a feel similar to that of natural fibers, as well as a process for making same, are disclosed. The filaments have an integral skin-core structure, with the core formed of oriented dense polymer and the skin formed of the same polymer, in a fibrous and vesicular form. The filaments are produced by spinning the filaments and quenching the filaments while in the molten state in an inert cooling medium having a temperature of less than 100°C. The inert cooling medium is a swelling agent for the polymer at temperatures above the polymer solidification point and a non-swelling agent for the polymer at temperatures less than 100°C, the degree of swelling progressively decreasing with the decrease of the polymer filament temperature from the polymer solidification temperature to the temperature of the cooling medium. The inert cooling medium is thereafter removed from the surface of the solidified filament, and the filaments are stretched at a draw ratio of at least two.

4 Claims, 17 Drawing Figures

SYNTHETIC FIBERS AND PROCESS FOR MAKING SAME

The filaments produced according to the present invention have multiple uses, among which may be mentioned the production of garments, as well as in the industrial field.

BACKGROUND OF THE INVENTION

Various types of synthetic fibers having different surface structures, as well as the processes for obtaining such fibers, are known to the art.

U.S. Pat. Nos. 3,102,323 and 3,184,369 disclose a process for treating unstretched filaments, by passing the filaments into a cracking agent bath (such as a bath of acetone, dimethyl formamide or dimethyl sulfoxide) to produce cracked fibers, and then stretching the cracked fibers to produce nodular fibers. British patent 1,199,385 discloses immersing a still molten filament in a crystallizing agent, and then stretching the surface-crystallized filaments to produce filaments having irregular rough surfaces with protuberances and ribs. French patent 1,078,949 discloses apparatus and process for treating filaments in the solidified state. The filaments are treated with a swelling agent, a hot fluid, and then a cold fluid to obtain a filament having a porous surface.

Products produced by the prior art possess various physical characteristics and particularly a coefficient of friction (filament on filament) which facilitates the manufacturing operations utilizing threads made from such filaments. Such filaments are capable of being used as brush bristles, ropes, non-woven fabrics, and the like. However, these filaments do not possess the desired qualities such as a dull appearance, natural touch and a flexibility for making garments which have sufficiently high physical properties. There prior art products are generally obtained by the action of a solvent liquid or crystallizing agent on the solidified unstretched fiber which is formed into its final shape during a subsequent stretching operation.

DESCRIPTION OF THE INVENTION

Synthetic filaments having a compact dense polymeric core and an integral fibrous vesicular skin of a thickness between 0.5 and 10 $\mu$ have a dull appearance and a feel similar to that of natural origin. The core and skin are formed of the same synthetic polymer and are connected without discontinuity.

The filaments, fibers and bristles of the present invention are opaque, with a dull appearance, even if the polymer is unpigmented. This appearance of the filaments results from a surface structure which differs considerably from filaments produced by prior processes. The novel surface structure of the present filaments is readily apparent from examination of the filaments with an optical microscope or with a sweeping electron microscope. The filaments of the present invention have a feel similar to that of natural fibers, of either animal origin or vegetable origin. The present filaments acquire a slight natural crimping of unusual appearance after mechanical treatment, such as superstretching. The filaments of the present invention can undergo all of the treatments usually applied to synthetic filaments such as thermal treatment, texturizing and the like.

The new structure of the filaments of the present invention results in such characteristics of volume, weak aptitude to electrification, rapid fixation of humidity and the like, that the filaments are suitable for use in garments wherein no known synthetic filament until now has the properties to enable the wearer to reach the degree of comfort provided by natural fibers. Furthermore, the filaments of the present invention are highly suitable for those applications requiring a large specific surface, including uses in adhesion processes, in the manufacture of heating fibers, in the manufacture of non-woven fabrics, etc.

The filaments of the present invention are produced by spinning a filament-forming synthetic polymer in the molten state. The molten filaments are immersed, after a short passage in air, in an inert cooling liquid medium having a temperature less than 100°C. The inert cooling medium swells the polymer when the polymer temperature is higher than the polymer solidification point. The inert cooling medium is a non-swelling agent for the polymer when the polymer is at the temperature of the cooling medium. The degrees of swelling of the polymer progressively decreases with the decrease of the temperature of the filament from the polymer solidification temperature to the temperature of the inert cooling medium.

DESCRIPTION OF THE DRAWINGS

FIG. 1 is a photograph, magnified 2000 times, of a typical unstretched filament after emergence from the inert cooling medium bath, It will be noted that the filament has a superficial entanglement of protuberances, vesicles and fibrilla.

Figure 1:
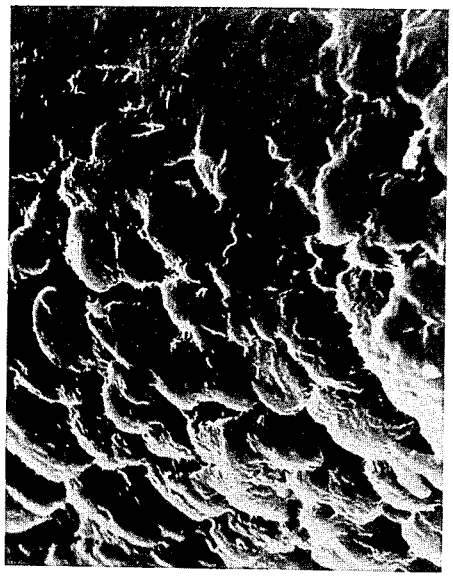
FIG. 1 is a photograph, magnified 2000 times, of a typical unstretched filament.
Figure 2:
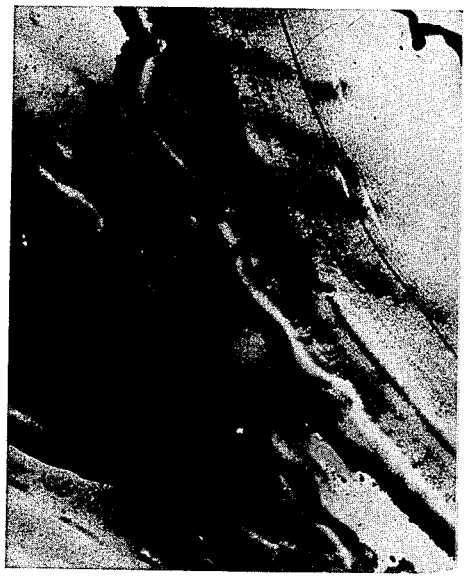
FIG. 2 is a photograph, magnified 9000 times, of a longitudinal cross-section of a stretched filament.

After the filament has been stretched, an examination of transverse sections of the filaments illustrates that the filaments are made of a core of synthetic polymer of identical appearance to the cores of conventional filaments, with this oriented relatively dense polymer core being surrounded by a skin having a thickness of no more than 0.25 d, wherein d is the filament diameter. The skin thickness is generally between 0.5 and 10$\mu$ and preferably between 2 and 5$\mu$. A typical filament, after the stretching operation, is shown in FIG. 2, which is a photograph of a longitudinal cross-section of a filament magnified 9000 times.

Figure 3:
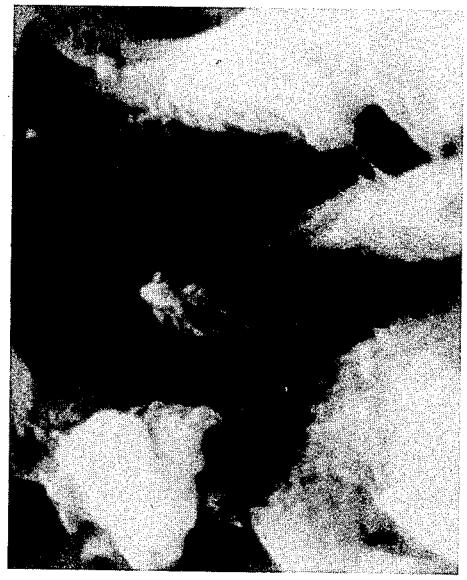
FIG. 3 is a photograph, magnified 10,000 times, of the surface of typical filaments of the present invention.

FIG. 3 is a photograph, magnified 10,000 times, of the surface of typical filaments of the present invention, illustrating that the surface or skin of the filament comprises a multitude of extremely agitated vesicles, the vesicles themselves being composed of an entanglement of fibrilla or rootlets enclosing less organized tufts of polymer.

Figure 4:
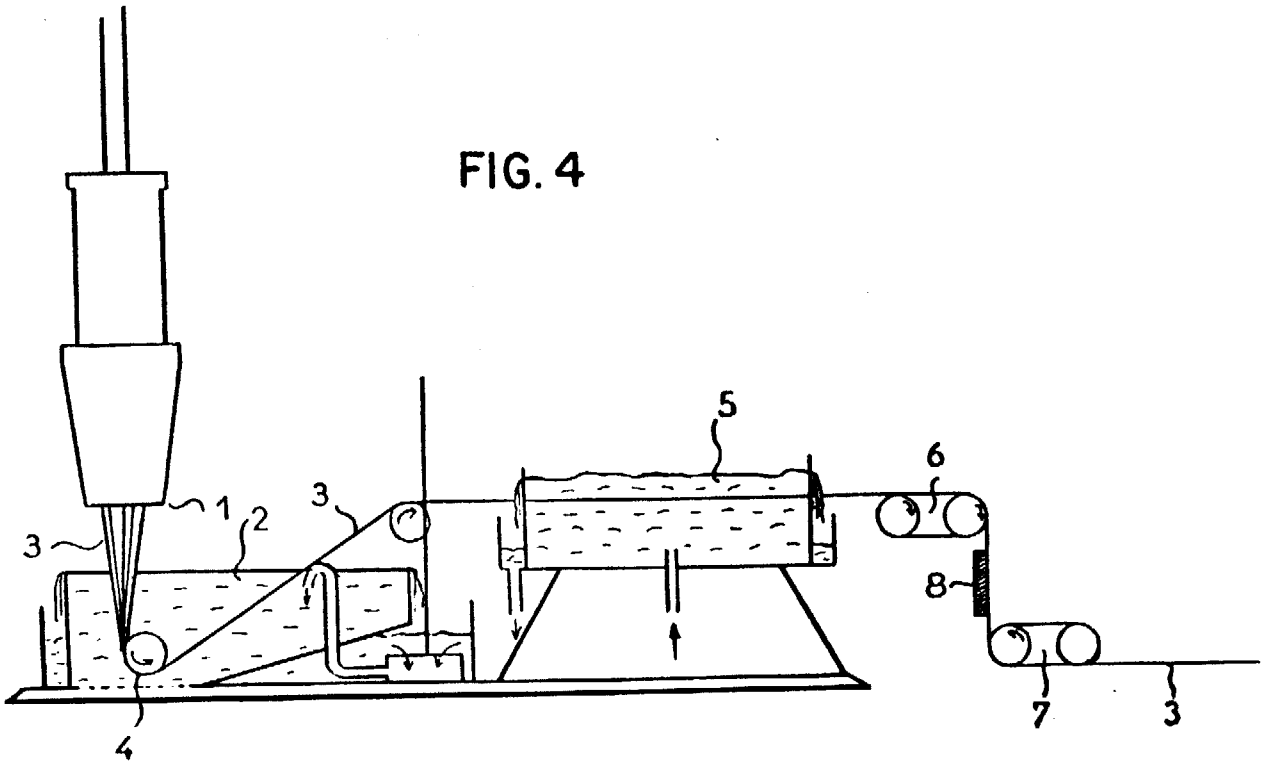
FIG. 4 is a schematic diagram of the process for producing the filaments of the present invention.

The process for producing the filaments of the present invention is schematically shown in FIG. 4. Filaments 3 in the molten state are formed by spinneret 1. The filaments are passed, while still in the molten state, into liquid bath 2. Liquid bath 2 contains an inert cooling liquid maintained at a temperature of less than 100°C. The inert cooling liquid is chosen for its particular swelling properties in relation to the spun polymer filament. This liquid must have a slight vapor pressure under the operating temperature, and a high boiling point, preferably substantially higher than 100°C, more preferably higher than 130°C. The inert cooling liquid must, of course, be chemically inert to the filaments. Furthermore, the inert cooling liquid must cause a superficial swelling of the polymer moving through the liquid before the polymer temperature drops, due to cooling by contact with the liquid, to the point that the polymer solidifies. At the point the polymer solidifies, the swollen polymer starts to deflate, with the deflation progressively occurring with the decrease of the polymer filament temperature, until the polymer reaches the temperature of the cooling liquid and has substantially obtained its ultimate appearance. The distance between the spinneret and the cooling bath surface must be less than the distance necessary for the filament to solidify while travelling through ambient air. Heating means could be used to increase this distance, but normally such action is unnecessary. The distance between the spinneret and the cooling bath surface is a function of the title of the filament and the spinning speed, and is generally less than 150 mm, preferably between 5 and 110 mm, and most preferably between 5 and 120 mm.

The temperature of the inert cooling medium bath must be maintained below 100°C, preferably between 5°C and 90°C, by appropriate cooling means (not shown).

The spinning speed is generally between 5 and 250 meters per minute, preferably between 50 and 150 meters per minute. The time that the filaments 3 pass through the cooling bath must be sufficient to insure total filament solidification. The filament must be solidified between the time the filament enters the bath and the time of first contact of the filament with a solid surface, which will generally be a return disk 4 located in the bath. This distance depends upon various factors including the spinning speed, the title of the filament and the degree of swelling acquired by the filament during immersion in the bath. This length can be very small, in some instances in the order of a millimeter or so, but is generally significantly larger for technological reasons. There is no upper limit for this distance.

The cooling bath may contain various additives dissolved in the bath. Such additives may be those types susceptible to superficial fixation on the filament, such as, for instance, dyestuffs, reticulating agents, fireproofing agents, plasticizing agents, softening agents, and the like.

After passing through the cooling bath, the filaments are passed through a washing bath 5 which contains a liquid which is inert to the polymer but is miscible in all porportions with the cooling bath liquid. The cooling bath liquid should be completely removed from the filament when the filament exits from the washing bath. The distance the filament travels in the washing bath will vary according to a number of factors, but is at least sufficient to result in a filament which is substantially free of cooling bath liquid. The temperature of the washing bath is conveniently ambient temperature but higher or lower temperatures may be used if desired.

The filaments are then subjected to a coventional stretching by known means. The stretching means may be either discontinuous or continuous. For instance, the filament may be passed over heated plate 8 between two pairs of rollers 6 and 7. They also can be stretched between two pairs of heated rollers. The draw ratio and the temperature of the drawing are dependent on the nature of the polymer to be drawn. Generally the draw ratio is 2 to 6 or even more; the temperature of drawing can vary between the room temperature and 170°C or more. After the stretching operation, the filament may be thermally treated, crimped, texturized, or subjected to other conventional treatments.

All polymers which can be spun in the molten state may be used in practicing the present process. Particularly preferred polymers are polyamides, polyesters, polyolefins, and copolymers of polyamides, polyesters and/or polyolefins.

Among suitable polyamides are Nylon-6, Nylon-6,6, Nylon-6,10, polyamide-11, and other polyamides described in Floyd, "Polyamide Resins," Reinhold Publishing Corp., New York, 1958, the disclosure of which is hereby incorporated by reference. Suitable polyesters are polyalkylene terephthalates wherein the alkylene unit contains 2 – 6 carbon atoms, including polyethylene terephthalate and polybutylene terephthalate. The polyolefins are polymers of olefins having 2 – 12 carbon atoms, including polyethylene, polypropylene, poly(4-methylhexene-1), and the like. As previously mentioned, copolymers may be used, including copolyamides, copolyesters and copolyolefins.

The polymer is normally spun at a spinneret temperature, according to the nature of said polymer, between the melting point of the polymer and the polymer degradation temperature.

The suitability of a particular compound for use as the inert cooling liquid may be readily determined by a simple test.

Dissolution tests have been made with a concentration of 1percent, by heating till ebullition in test-tubes, 0.05 g of stretched yarn having a regular count, in 5 $cm^3$ of the cooling liquid to be tested.

The products which are suitable to be used are those in which the yarn is quite soluble before or near ebullition and which, after cooling, give a solid phase such as precipitate or gel.

Among particular combinations of polymer and inert cooling medium which are particularly preferred are the following:

| Polymer | Inert Cooling Liquid |
|---|---|
| Polyamide | Benzyl alcohol |
| | Ethylene glycol |
| | Diethylene glycol |
| | Trimethylene glycol |
| | Triethylene glycol |
| | Formamide |
| | Ethanolamine |
| | γ-butyrolactone |
| | 1,4 butane diol |
| | N-methyl pyrrolidone |
| Polyester | Benzyl alcohol |
| | Cyclohexanol |
| | Triethylene glycol |
| | Benzaldehyde |
| | 1-2-dichlorobenzene |
| | Nitrobenzene |
| | γ butyrolactone |
| | Dimethylformamide |
| | Aniline |
| | N-methylaniline |
| Polypropylene | Cyclohexanol |
| | Heptanol |
| | Octanol |

If desired, the inert cooling medium may be a mixture of pure miscible compounds with each other.

EXAMPLES OF THE INVENTION

The invention will be more clearly understood with reference to the following examples. In the examples, the following test procedures were used: — the relative viscosity of the polyamides (i.e., the ratio between the viscosity of the solution and the viscosity of the pure solvent) was determined on a solution containing 8.4 percent by weight of polymer in a 90 percent formic acid solution at 25°C.

the intrinsic viscosity of polyesters was determined on a 1 percent concentration solution (weight/volume) of the polyester in orthochlorophenol at 25°C.

the inherent viscosity of polyesters is expressed by the formula IV = specific viscosity/concentration × 1000 wherein the concentration is expressed in g/100 ml, and the specific viscosity is determined at 25°C on a solution containing 1 percent (weight/volume) of polymer in orthochlorophenol.

the "toughness index" corresponds to the half-product of the tensile strength the elongation the luminescence (Y percent) and the yellowing index (IJ) are measured on an Elrepho photocolorimeter (Zeiss) according to the method described in the second edition of Kirk Othmer' s Encyclopedia of Chemical Technology (John Wiley, 1964) Vol. 5, p. 802 at 805 the thermalstability is expressed in terms of the loss of tensile strength in percent, after a sample was maintained at 150°C in dry air for 4 hours.

the apparent density is determined on filaments wound under a winding tension of 50 mg/dtex.

the water absorption is measured as the time in seconds for a drop of water placed on a roll of the filaments to disappear.

the wetness index is the time in seconds for a ball of the filaments placed on the water surface to be totally submerged.

the electrification is expressed by the electric charge accumulating on the filament, measured by a Rotschild electrometer.

the coefficient of friction (filament on filament) is based on the tensions upstream and downstream, measured by the Rotschild electronic tensiometer, or a filament in motion (20 m/mn) wrapped one or several times on itself.

EXAMPLE 1

Poly(hexamethylenediamine adipate) having a relative viscosity of 33 was spun through a spinneret having 7 apertures of 0.1 mm in diameter at a speed of 55 meters per minute at a spinneret temperature of 279°C. The resulting 7 filaments, while in the melted state, were passed into a bath of N-methyl pyrrolidone maintained at 40°C. The N-methyl pyrrolidone bath surface was located 8 mm below the lower face of the spinneret. The filaments traveled a distance of 150 mm in the N-methyl pyrrolidone at a speed of 55 meters per minute, and then the resulting solidified filaments were passed through a bath of countercurrent circulating water 1.20 meters in length. Finally, the filaments were stretched on a heated plate maintained at 108°C at a speed of 178 meters per minute, corresponding to a stretching rate of 3.24.

Control filaments were spun under identical conditions, except the filament was cooled in ambient air till their solidification with no countercurrent circulating water bath, and then stretched to a draw ratio of 3.24.

Figure 5:
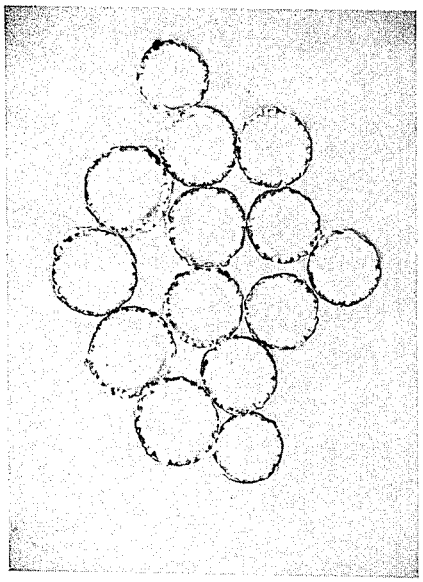
Figure 6:
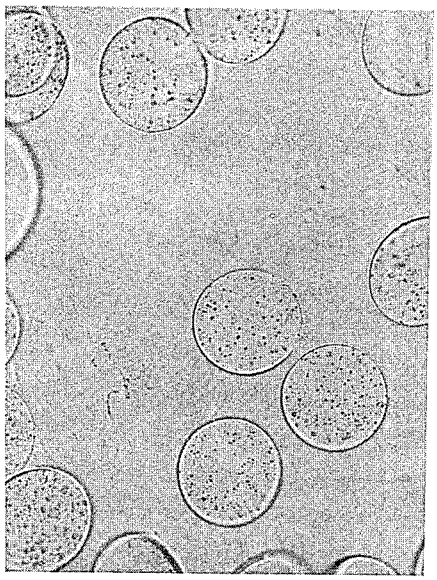
Figure 7:
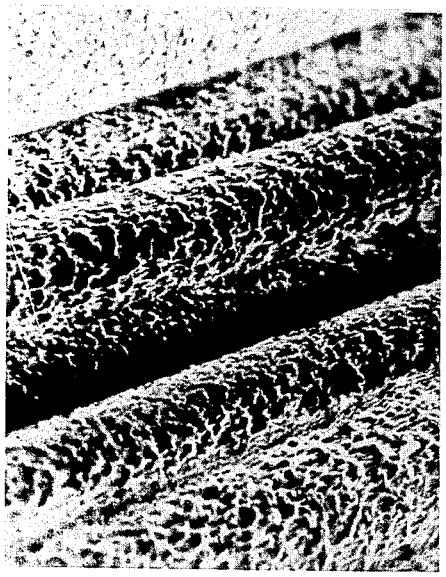
Figure 8:
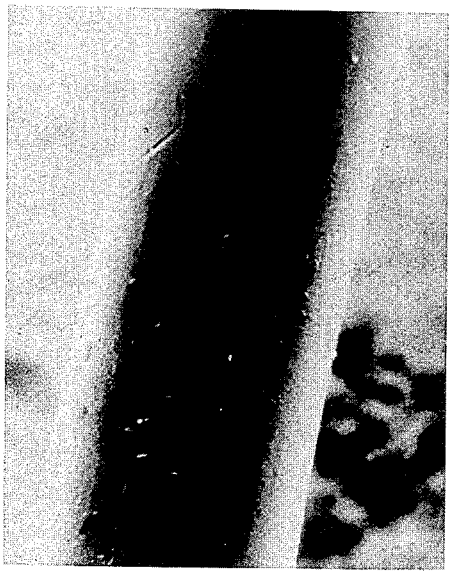

FIGS. 5 and 6 are photographs of sections of the filaments magnified 500 times. FIG. 5 is a section of the filament spun into the N-methyl pyrrolidone bath, and FIG. 6 is a section of the filaments cooled in ambient air. FIGS. 7 and 8 are photographs of the filaments magnified 2000 times. FIG. 7 is a photograph of the surface of a filament spun into the N-methyl pyrrolidone bath, and FIG. 8 is a photograph of the surface of a filament cooled in ambient air.

FIGS. 5 – 8 demonstrate that the filaments of the present invention, unlike filaments cooled in ambient air, have a porous skin of about 4$\mu$ thickness, formed of fibrillary protuberances connected to each other by a system of oriented ligaments.

The physical characteristics of the filaments of this example and of the control example are set forth in the following Table I.

TABLE I

| Characteristics | | Fiber Spun in N-Methyl Pyrrolidone | Fiber Spun in Air |
|---|---|---|---|
| Dry dynamometry | | | |
| Title | dtex | 35 | 35 |
| Tensile Strength | g/tex | 27 | 47 |
| Elongation | % | 60 | 32 |
| Toughness index | g/tex | 810 | 750 |
| Modulus of elasticity | g/tex | 180 | 300 |
| Wet dynamometry | | | |
| Tensile Strength | g/tex | 27 | 42 |
| Elongation | % | 60 | 36 |
| Toughness index | g/tex | 810 | 755 |
| Boiling /Water shrinkage | % | 6.5 | 9.5 |
| Thermal stability | | 16 | 23 |
| Color : I.J. | | 10 | 2 |
| Y% | | 82 | 70 |
| Density | | 1.155 | 1.1415 |

Similar fibers were spun, and then passed into a bath of N-methyl pyrrolidone, and treated at 180°C, for 30 seconds through dry air under a tension of 9 g/tex. The filaments then had the following dry dynamometric characteristics values:

| | |
|---|---|
| Tensile strength | 45 g/tex |
| Elongation | 17.8% |
| Toughness index | 400 g/tex |
| Modulus of elasticity | 417 g/tex |

Consideration of Table I above will indicate that the principal characteristics of the filaments of the present invention are close to those of filaments produced according to conventional methods. The tensile strength of the filament of the present invention is somewhat less than that of the control filament, in the dry as well as in the wet state, but the filament of the present invention had a higher elongation to rupture and a toughness index, which characterizes the level of the aggregate of the mechanical properties of the filament, which was higher by a factor of about 8 percent. These improved properties indicate that the presence of a visiculated skin or coating does not decrease the overall physical properties of the filament.

Table II set forth below indicates the filament properties which are of concern during handling and finishing treatments, as well as for the ultimate end use.

TABLE II

| Properties | Fiber Spun in N-Methyl Pyrrolidone | Fiber Spun in Air |
|---|---|---|
| Apparent Density | 0.76 | 0.91 |

TABLE II-continued

| Properties | Fiber Spun in N-Methyl Pyrrolidone | Fiber Spun in Air |
|---|---|---|
| Water Absorption | immediate | 5 seconds |
| Wetness | 10 to 60 | 300 to 480 |
| Feel | natural, rather rough | synthetic |

It will be readily appreciated that the properties of the filaments of the present invention are closer to those of fibers of natural origin than filaments which are spun in air.

EXAMPLE 2

Poly(hexamethylenediamine adipate) having a relative viscosity of 33 was spun through a spinneret having 3 apertures of 0.1 mm in diameter at a spinneret temperature at 273°C and a spinning speed at 55 meters per minute. The filaments, still in the melted state, were passed into a bath of ethylene glycol maintained at 40°C, with the surface of the bath located 15 mm from the face of the spinneret. The filaments traveled a distance of 150 mm in the ethylene glycol bath, and then the solidified filaments were passed through a water bath for a distance of 1.20 meters. Thereafter, the filaments were stretched on a heated plate maintained at 135°C at a speed of 170.5 meters per minute, corresponding to a stretching rate of 4.26.

Figure 9:
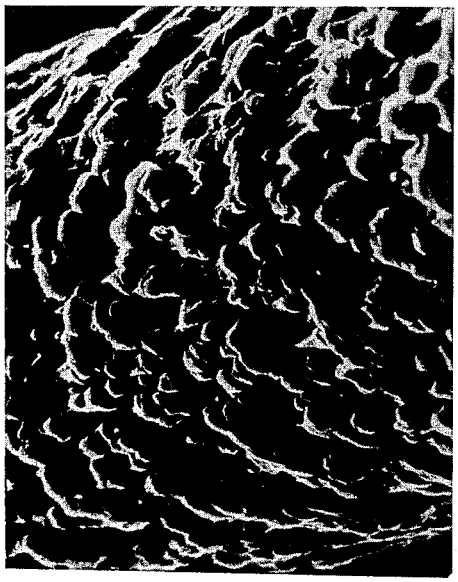

The resulting filaments have a dull appearance due to the cellular structure of the skin, which was about $3\mu$ thick. The surface of the filament is shown magnified 2000 times in FIG. 9.

The physical characteristics of the filaments are set forth in the following table:

| | | |
|---|---|---|
| Title | in dtex | 26.7 |
| Tensile strength | in g/tex | 37.5 |
| Elongation to rupture | in % | 32.5 |
| Modulus of elasticity | in g/tex | 231 |
| Boiling water shrinkage | % | 9.5 |
| Thermal stability | % | 3 |

EXAMPLES 3, 4 and 5

These examples relate to using three different polyamides. Polycapronamide was used in Example 3, poly(hexamethylene diamine sebacate) was used in Example 4 and polyundecanamide was used in Example 5. Each polymer was spun through a spinneret having one aperture of 0.23 mm in diameter at a spinneret temperature and spinning speed set forth in Table 3. The filaments were passed to a N-methyl pyrrolidone bath located 15 mm below the lower face of the spinneret. The filaments traveled a distance of 150 mm through the cooling bath which was maintained at 40°C. The solidified filaments were passed through a water bath, as described in Example 1, and then subjected to a continuous stretching operation over a heated plate, with the stretching conditions set forth in Table 3 below:

TABLE III

| Example | 3 | 4 | 5 |
|---|---|---|---|
| Spinneret temperature, °C | 276 | 279 | 236 |
| Spinning speed, m/mn | 50 | 49 | 50 |
| Stretching speed, m/mn | 166 | 98 | 179 |
| Temperature of stretching plate,°C | 135 | 85 | 10 |

TABLE III-continued

| Example | 3 | 4 | 5 |
|---|---|---|---|
| Stretching rate | 3.3 | 2 | 3.6 |

Figure 10:
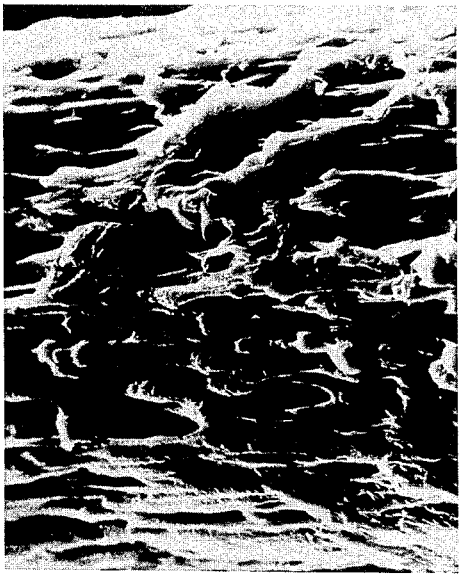
Figure 11:
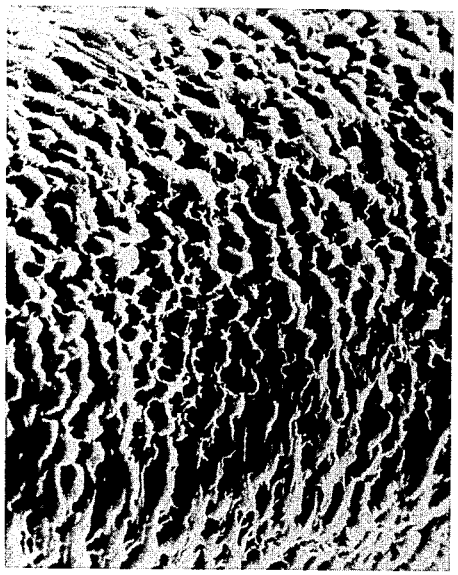
Figure 12:
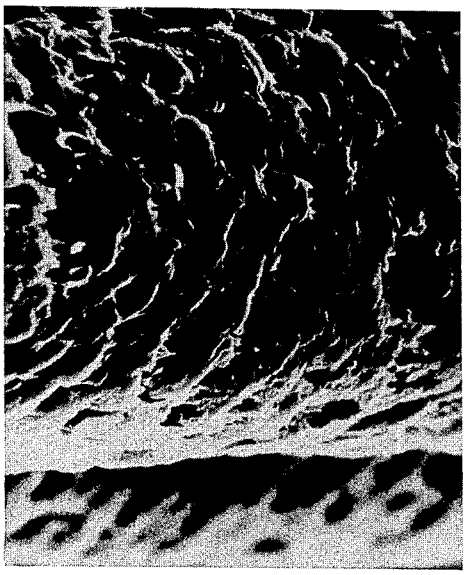

FIGS. 10, 11 and 12 represent photographs of the surfaces of the filaments, magnified 2000 times, of Examples 2 – 5 respectively.

Table 4 below sets forth the physical characteristics of the filaments of Examples 3, 4 and 5.

TABLE IV

| Example | | 3 | 4 | 5 |
|---|---|---|---|---|
| Title | dtex | 21.8 | 32.1 | 22.3 |
| Tensile strength | g/tex | 27.6 | 19.9 | 35.6 |
| Elongation to rupture | % | 62.6 | 62.3 | 41.3 |
| Modulus of elasticity | g/tex | 107 | 159 | 164 |
| Boiling water shrinkage | % | 13.2 | 9.7 | 9.6 |
| Thermal stability | % | 38.5 | 67 | 43 |

EXAMPLE 6

A copolyamide of adipic acid, terephthalic acid and hexamethylenediamine, containing 70 moles of adipic acid for each 30 moles of terephthalic acid, having a relative viscosity of 28.8, was spun through a spinneret having a single aperture 0.23 mm in diameter, with the spinneret maintained at 279°C at a spinning speed of 40 meters per minute. The molten filaments were passed to an ethylene glycol bath, the surface of which was located 15 mm below the lower face of the spinneret. After being in contact with the ethylene glycol bath for $22.10^{-2}$ seconds, the filaments were passed through a water wash bath and then stretched on a heated plate maintained at a temperature of 120°C. The filaments were stretched at a speed of 166.5 meters per minute, corresponding to a stretching rate of 4.16.

Figure 13:
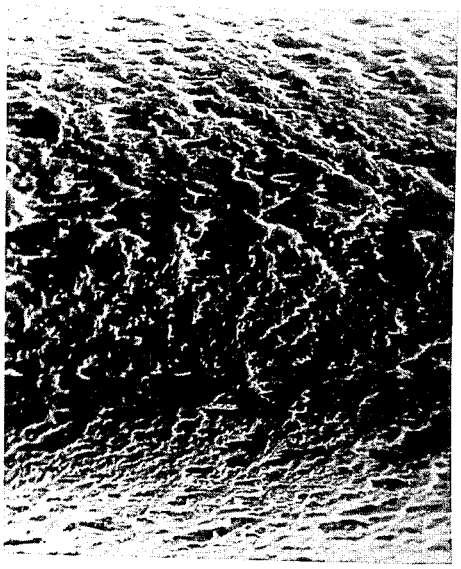

The fine superficial disturbances produced a fiber appearance which was at the same time dull and glossy is illustrated in FIG. 13, which is a photograph of the surface of the filament magnified 2000 times.

EXAMPLE 7

Example 6 was repeated, except the ethylene glycol bath was replaced by a bath of N-methyl pyrrolidone containing 5 percent by weight of Soluble Black PLSPS of FMC (dyeing mixture of anthraquinone and perinone derivatives).

The resulting filament, which was black and had a dull appearance, had the following physical characteristics:

| | | |
|---|---|---|
| Title | dtex | 26.3 |
| Tensile strength | g/tex | 35.4 |
| Elongation to rupture | % | 46.9 |
| Modulus of elasticity | g/tex | 320 |
| Boiling water shrinkage | % | 10.8 |
| Thermal stability | % | 0 |

EXAMPLE 8

Polyethylene terephthalate, having an intrinsic viscosity of 0.65 was extruded at 267°C through a spinneret aperture 0.23 mm in diameter. The molten filament was passed through a bath of benzyl alcohol maintained at 41°C, the surface of which was located at 15 mm from the spinneret surface.

The filament was solidified in the benzyl alcohol bath thru which it was passed for a distance of 150 mm and was then continuously washed with acetone to remove the benzyl alcohol therefrom. Finally the filament was stretched on a heated plate maintained at 120°C and a stretching speed at 172 meters per minute, corresponding to a stretching rate of 4.3 fold.

Figure 14:
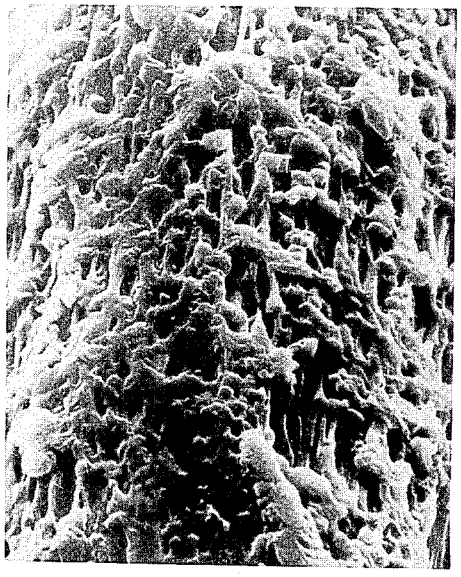

The resulting filament had a dull appearance and soft feel, due to the surface of the filament, which is illustrated in FIG. 14, which is a photograph of the filament surface magnified 2000 times.

The filament had the following physical characteristics:

| | | |
|---|---|---|
| Title | dtex | 29.9 |
| Tensile strength | g/tex | 32.3 |
| Elongation to rupture | % | 59.6 |
| Modulus of elasticity | g/tex | 436 |
| Boiling water shrinkage | % | 12.3 |
| Thermal stability | % | 9 |
| Skin thickness | μ | 4 |

EXAMPLE 9

Figure 15:
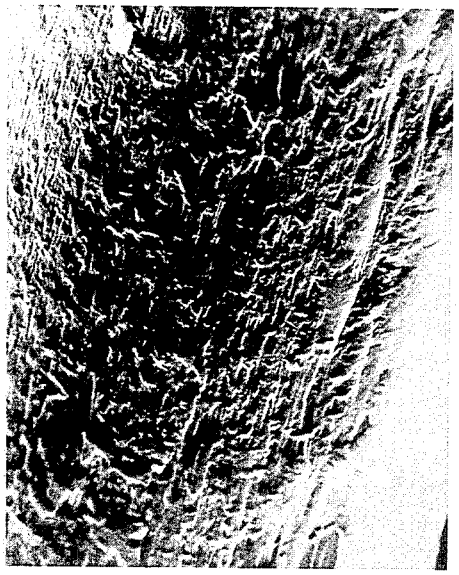

Example 8 was repeated, except the molten filament was passed into a dimethylformamide bath. The solidified filament was washed in a water bath and then stretched using the conditions of Example 8. The resulting filament had a very dull appearance, and is illustrated by FIG. 15, which is a photograph of the surface of the filament magnified 2000 times.

The physical characteristics of the filaments of this example are as follows:

| | | |
|---|---|---|
| Title | dtex | 21 |
| Tensile strength | g/tex | 26.9 |
| Elongation to rupture | % | 59.6 |
| Modulus of elasticity | g/tex | 554 |
| Boiling water shrinkage | % | 9.3 |
| Thermal stability | % | 9 |
| Skin thickness | μ | 1 |

EXAMPLE 10

Polybutylene terephthalate (produced from terephthalic acid and 1,4-butane diol), having a viscosity index of 115 and a viscosity in the molten state of 3150 poises, was spun at 266°C at a speed of 35.6 meters per minute through a spinneret having 23 apertures having a diameter of 0.10 mm into a N-methyl pyrrolidone bath maintained at 40°C, the surface of which was 15 mm from the spinneret face. The filaments were passed through the N-methyl pyrrolidone bath for a distance of 150 mm. The filaments were then passed through a water washing bath maintained at ambient temperature, and were then stretched on a heated plate maintained at 140°C at a speed of 184.6 meters per minute, corresponding to a stretching rate of 5.18.

Figure 16:
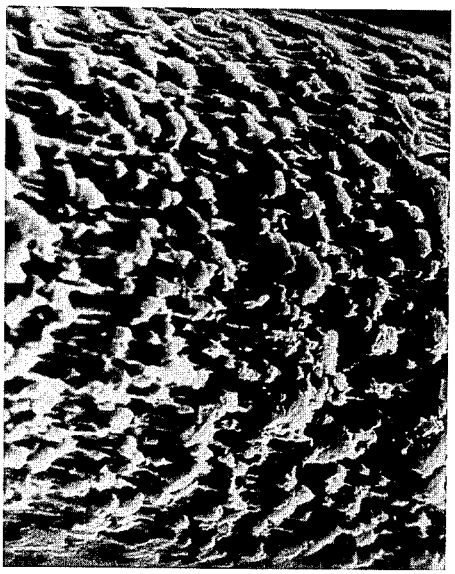

The resulting filament had a dull appearance and silky feel. FIG. 16 is a photograph of the surface of the filament, magnified 2000 times.

A yarn was made from 23 filaments, and the yarn had a title of 87 dtex, a tensile strength of 35.6 g/tex, an elongation of 38 percent, and a modulus of elasticity of 400 g/tex.

In comparison, a control filament was spun under identical conditions, but passing the molten filament through atmospheric air to cool and solidify same. The control filament was stretched under the same conditions. The control filament had a lower electrification value, being only 2000 volts against 5000 volts for the filament of Example 10, and also a lower coefficient of friction (filament on filament) being only 0.17 as compared to 0.20 for the filament of Example 10.

EXAMPLE 11

Polypropylene MW 23, Societe Normande de Matieres Plastiques, was extruded at 220°C at a speed of 35 meters per minute, through a spinneret aperture 0.23 mm in diameter, and passed, while still in the molten state, to a bath of 1,2-dichlorobenzene maintained at a temperature of 40°C and located 15 mm below the spinneret surface. The filament was maintained in the 1,2-dichlorobenzene bath during a time it traveled a distance of 150 mm in the bath.

The 1,2-dichlorobenzene was removed from the filament surface by washing with ethyl alcohol. Then the filament was stretched on a heated plate maintained at a temperature of 80°C at a speed of 170 meters per minute, corresponding to a stretching rate of 4.85.

Figure 17:
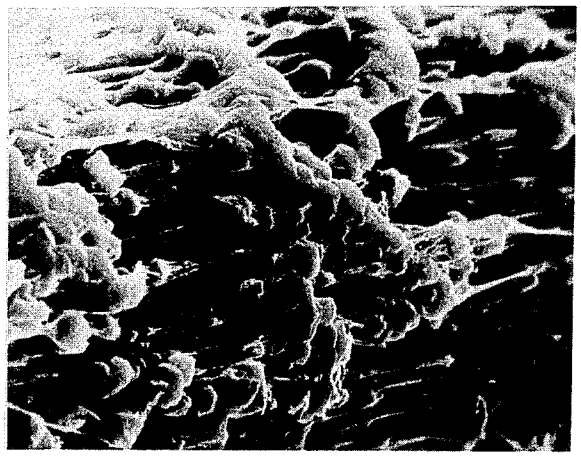

The filament, which had a dull appearance, is illustrated by FIG. 17, which is a photograph of the filament surface magnified 2000 times. The filaments had the following physical characteristics.

| | | |
|---|---|---|
| Title | dtex | 18.2 |
| Tensile strength | g/tex | 33.1 |
| Elongation to rupture | % | 32.3 |
| Modulus of elasticity | g/tex | 478 |
| Boiling water shrinkage | % | 6.1 |
| Skin thickness | μ | 6 |

What is claimed is:

1. Synthetic polymer filaments having a dull appearance and a feel similar to natural fibers, said filaments being selected from the group consisting of polyamide, polyester and polyolefin, and having an integral core-skin structure, said core of oriented dense polymer, and said skin of fibrous vesicular polymer having a thickness of about 2 to 6μ and having protuberances, vesicles and fibrilla.

2. Filaments according to claim 1, wherein said skin has a thickness of 2 – 5 μ.

3. Filaments according to claim 1 made of polyhexamethylenediamine adipate, polycapronamide, polyhexamethylenediamine sebacate, polyundecanamide, polyhexamethylenediamine adipate/terephthalate, polyethylene terephthalate, polybutylene terephthalate or polypropylene.

4. Filaments according to claim 1, wherein the skin has a thickness no greater than 0.25d, wherein *d* is the filament diameter.

* * * * *

UNITED STATES PATENT OFFICE

CERTIFICATE OF CORRECTION

Patent No. 3,944,708 Dated March 16, 1976

Inventor(s) Victor Dumas Page 1 of 2

It is certified that error appears in the above-identified patent and that said Letters Patent are hereby corrected as shown below:

IN THE DRAWINGS:

Add Figure 4, as shown on the attached sheet.

Signed and Sealed this

Seventh Day of September 1976

[SEAL]

*Attest:*

RUTH C. MASON
*Attesting Officer*

C. MARSHALL DANN
*Commissioner of Patents and Trademarks*